US005993260A

United States Patent [19]

Lindquist

[11] Patent Number: 5,993,260

[45] Date of Patent: Nov. 30, 1999

[54] FUSE HOLDER

[75] Inventor: Carl E. Lindquist, Bridgewater, N.J.

[73] Assignee: San-O Industrial Corporation, Holbrook, N.Y.

[21] Appl. No.: 09/046,938

[22] Filed: Mar. 23, 1998

[51] Int. Cl.[6] ..... H01R 13/68

[52] U.S. Cl. ..... 439/621; 439/622

[58] Field of Search ..... 439/621, 622, 439/721–724, 62, 79–80

[56] References Cited

U.S. PATENT DOCUMENTS 5,088,940 2/1992 Saito ..... 439/621

5,111,176 5/1992 Lindquist ..... 337/188

*Primary Examiner*—Steven L. Stephan

*Assistant Examiner*—Eugene G. Byrd

[57] ABSTRACT

A fuse holder is provided comprising a fuse box having opposed top and bottom walls, opposed side walls and opposed faces wherein the fuse box has a plurality of fuse cavities each extending from the front face toward the rear face terminating short of said rear face. Each fuse cavity is substantially parallel to the side walls and substantially perpendicular to the top and bottom walls, and a contact is disposed within each cavity electrically connected to a conductor extending through the rear face of the fuse box.

14 Claims, 3 Drawing Sheets

FUSE HOLDER

FIELD OF THE INVENTION

This invention relates generally to fuse holders and is particularly related to a fuse holder adapted for mounting on printed circuit boards (PCB). More particularly, the present invention relates to a fuse holder which permits right angle mounting to the edge of the PCB. In a more specific aspect, the present fuse holder has fuse cavities which are spaced horizontally rather than vertically on the circuit board, thus allowing increased number of electrical circuits per surface area of the circuit board.

BACKGROUND OF THE INVENTION

It is a common practice to protect circuits and associated components on PCB's by the use of one or more fuse holders which are mounted on, or snapped onto the circuit board . In one earlier fuse holder, the fuse cavities were spaced in parallel planes above the PCB surface thus limiting the number of fuses which can be accommodated in the fuse holder to one or two fuses. See, e.g., U.S. Pat. No. 5,111,176 issued May 5, 1992 for Dual Position, Flat Mount Piggyback Fuse Holder, and U.S. Pat. No. 5, 114,168 issued May 12, 1992 for Single Position Flat Mount Fuse Holder, both granted to Carl E. Lindquist, the applicant herein, and assigned to San-O Industrial Corporation, Holbrook, N.Y.

It has now been discovered that by rotating the fuse cavities approximately 90 degrees, the member of fuse positions can be practically unlimited. Thus, by spacing the fuse cavities horizontally rather than vertically relative to the surface of the PCB, the number of electrical circuits can be increased significantly.

Accordingly, it is an object of this invention to provide a fuse holder which can be right angle mounted to the edge of a PCB while being mechanically mounted to a vertically oriented panel.

It is a further object of this invention to provide a fuse holder which comprises a plurality of spaced cavities which are spaced horizontally in order to increase the number of electrical circuits per surface area of the circuit board.

It is also an object of this invention to provide a multiple position fuse holder which may be placed in a circuit board with predetermined contact spacing permitting insertion with one operation for numerous fuse positions.

The foregoing and other features and advantages of the fuse holder of the present invention will be more clearly comprehended and appreciated from the ensuing detailed description and the accompanying drawings.

SUMMARY OF THE INVENTION

In accordance with this invention, there is provided a fuse holder comprising a fuse box having opposed top and bottom walls, opposed side walls and opposed front and rear faces. The fuse box has a plurality of fuse cavities which extend from the front face towards the rear face terminating short of said rear face. Each fuse cavity is substantially parallel to the side walls and substantially perpendicular to the top and bottom walls. A conductive member is disposed within each cavity which is electrically connected to a connector extending through the rear face of the fuse box.

BRIEF DESCRIPTION OF THE DRAWINGS

In the drawings wherein like reference numerals designate like parts.

DETAILED DESCRIPTION OF INVENTION

Figure 1:
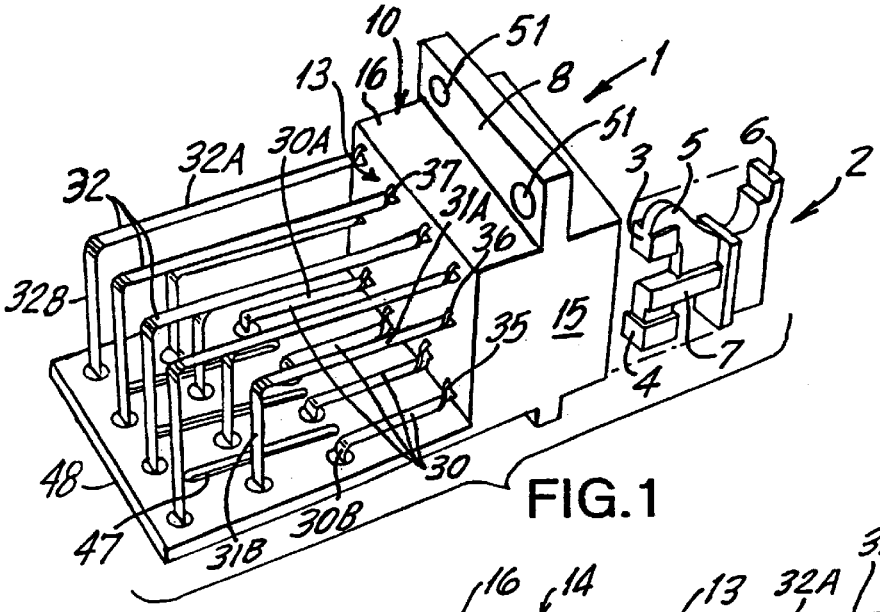
FIG. 1 an exploded perspective view of a fuse holder made in accordance with the present invention and showing a fuse in position to be inserted into the fuse cavity of the fuse older.
Figure 2:
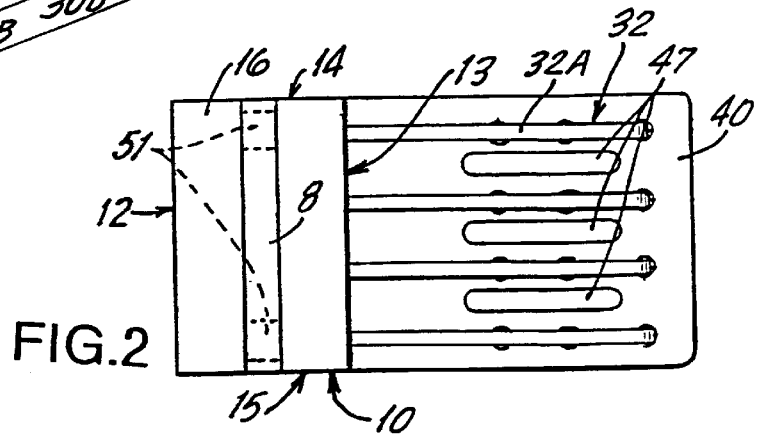
FIG. 2 is a top view of the fuse holder shown in FIG. 1.

Referring now to the drawings, with particular reference first to FIG. 1, there is shown a fuse holder 1 adapted to accommodate a plurality of fuses 2. In general, each fuse 2 has front portion 7 with vertically spaced forward facing upper and lower contacts 3 and 4 and a resilient leaf spring contact 5 adapted to flex upwardly when the fuse is operated by an overload current. The fuse 2 has a generally flat configuration and has a top grip portion 6 for manual insertion and removal of the fuse 2 in the fuse holder 1.

The fuse holder 1 comprises a fuse box 10 having a plurality of elongated, flat fuse holding cavities 11 therein, each of which is adapted to receive a fuse 2 as shown in FIG. 1. The fuse box 10 is shown in rectangular form with opposed parallel front and rear faces 12 and 13, respectively, opposed parallel side walls 14 and 15 and opposed parallel top and bottom walls 16 and 17, respectively. Anchoring flanges 8 and 9 may extend upwardly and downwardly from the top and bottom walls 16 and 17, respectively, of the fuse box 10.

Each of the fuse cavities 11 extends inwardly from the front face 12 and comprises opposed parallel internal side walls 18 and 19, an internal rear wall 20 at right angles to internal side walls 18 and 19 and opposed internal top and bottom walls 21 and 22, respectively, which are at right angles to the internal rear wall 20 and to the internal side walls 18 and 19. The internal rear wall 20 of each cavity 11 comprises a lower contact 23, a middle contact 24 and an upper contact 25. The lower and the middle contacts 23 and 24 are each in the form of a U-shaped clip adapted to receive the lower and upper contacts 3 and 4 of the fuse 2. The upper contact 25 is a strip contact positioned along the internal top wall 21 of the fuse cavity 11 and is adapted to be struck by the leaf spring contact 5 when the fuse 2 operates due to an overload current condition.

Extending through the rear wall 13 of the fuse box 10 in the form of conductors 35, 36 and 37 are electrically connected internal contacts 23, 24 and 25, respectively, in each cavity 11, which are a plurality of L-shaped leads 30, 31 and 32. Each lead 30, 31 and 32 has a horizontal leg 30A, 31A and 32A and downwardly extending vertical leg 30B, 31B and 32B. The horizontal legs 30A, 31A and 32A extend through rear wall 13 and are in electrical contact with internal contacts 23, 24 and 25, respectively, through conductors 35, 36 and 37 which are integral parts of the leads 30, 31 and 32. The vertical legs 30B, 31B and 32B extend down through a copper clad board 40 and terminate in contact tips 30C, 31C and 32C. The copper clad board 40 is maintained in a specific horizontal position relative to the contact tips by solder points, including 41, 42 and 43, which hold the array of vertical legs 30B, 31B and 32B to the copper clad board 40 as they extend therethrough. The copper clad board 40 is held in a position coextensive with the bottom wall 17 of the fuse box 10 and is held in place by the array of vertical legs, including 30B, 31B and 32B, being soldered at 41, 42 and 43 or otherwise mechanically connected to the copper clad board 40 at the proper height to keep it in the desired position. The lower surface 48 of the conducting board 40 is provided with mechanical standoffs 44, 45 and 46 for a purpose which will be described hereinbelow. The copper clad board 40 also has a plurality of elongated openings 47 to enhance cleaning fluid flow across the soldered PCB connections, reduced weight and reduced material.

In the drawings, four fuse cavities 11 are shown in parallel relationship to each other and to the side walls 14 and 15. Hence, four sets of three leads 30, 31 and 32 from each fuse holder cavity are shown in the drawing. They are ultimately perpendicular to the plane of the bottom wall 17 and to the plane of the conducting board 40. However, it will be understood that any number of cavities 11 may be provided in parallel relationship to each other and with each fuse cavity 11 a set of leads 30, 31 and 32 is provided. Depending on the purpose of the fuse box 10 any number of cavities 11 may be provided side by side. The orientation of the fuse cavities 11 vis-a-vis the copper clad board 40 permits this versatility.

In the embodiment shown in the drawing, a flat circuit board 60 having a plurality of electrical contacts 61, 62 and 63 is mounted beneath the copper clad board 40 and held in place by any well-known means. The circuit board electrical contacts 61, 62 and 63 are adapted to make electrical contact with the ends 30C, 31C and 32C of the leads 30, 31 and 32 which extends through the conducting board 40. These contacts 61, 62 and 63 may be in the form of plated through holes (FIG. 8) into which the ends 30C, 31C and 32C of the leads 30, 31 and 32 may be soldered. However, the circuit board 60 may be provided with any form of contacts to electrically connect to the ends 30C, 31C and 32C. In the embodiment shown herein, the lower surface 48 of the copper clad board 40 is spaced from the upper surface 64 of the circuit board 60 by standoffs 44, 45 and 46 to permit flux residue, cleaning solutions, dirt, etc. to be completely removed from between the two surfaces to avoid circuit degradation.

Figure 3:
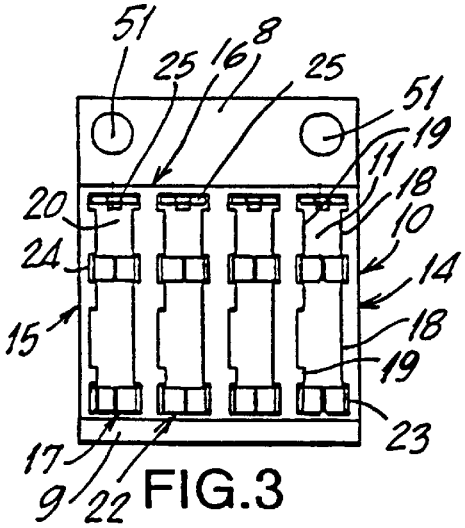
FIG. 3 is a front view of the fuse holder shown in FIG. 1.
Figure 4:
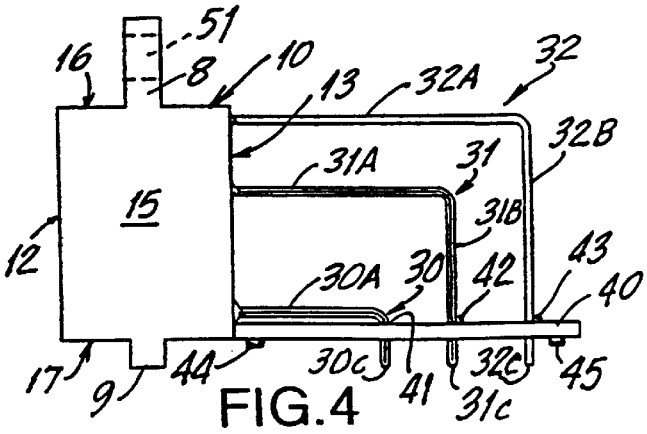
FIG. 4 is a side view of the fuse holder shown in FIG. 1.
Figure 5:
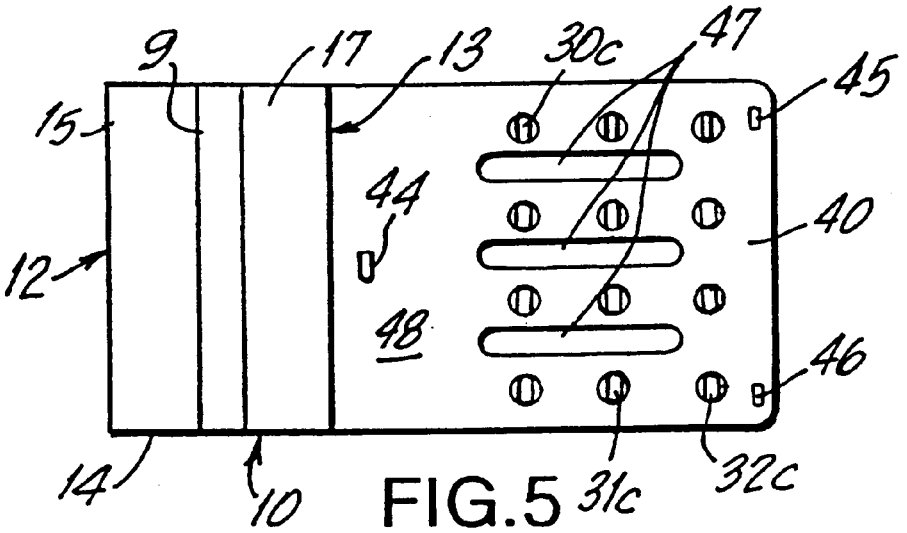
FIG. 5 is a bottom view of the fuse holder shown in FIG. 1.
Figure 8:
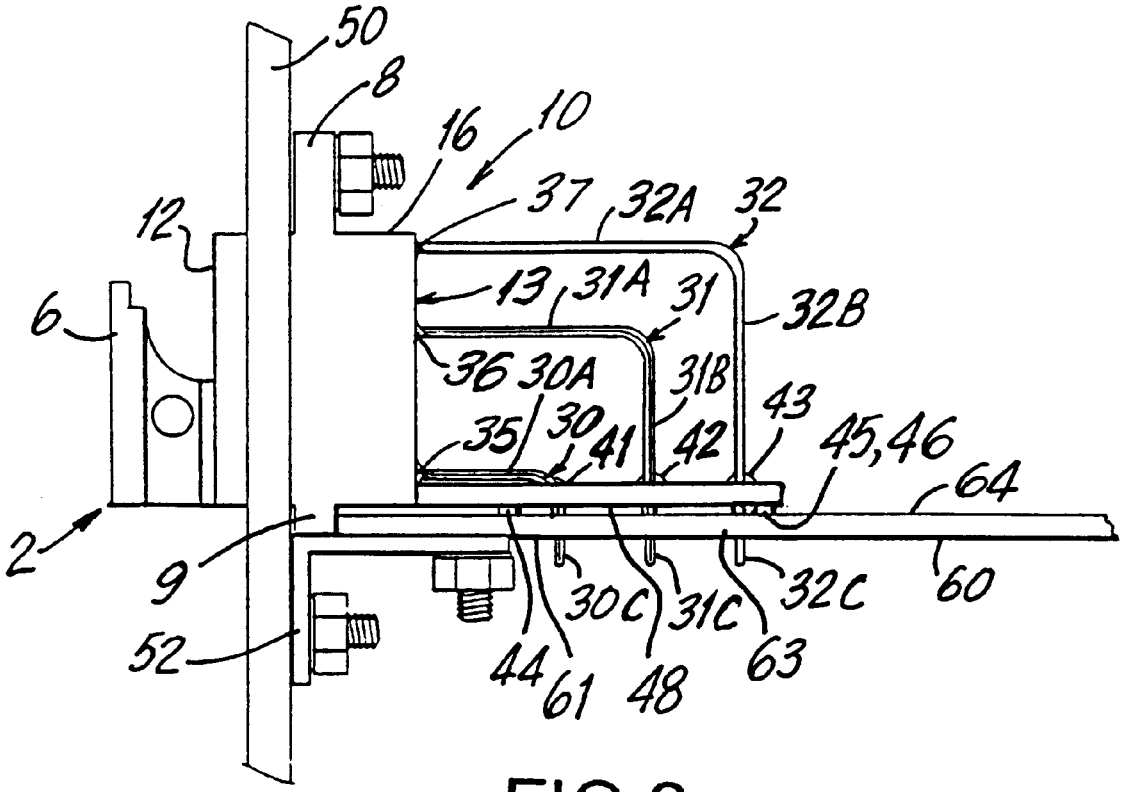
FIG. 8 is a side elevational view of one embodiment of the fuse holder of the present invention shown mounted in operative position on a circuit board.
Figure 6:
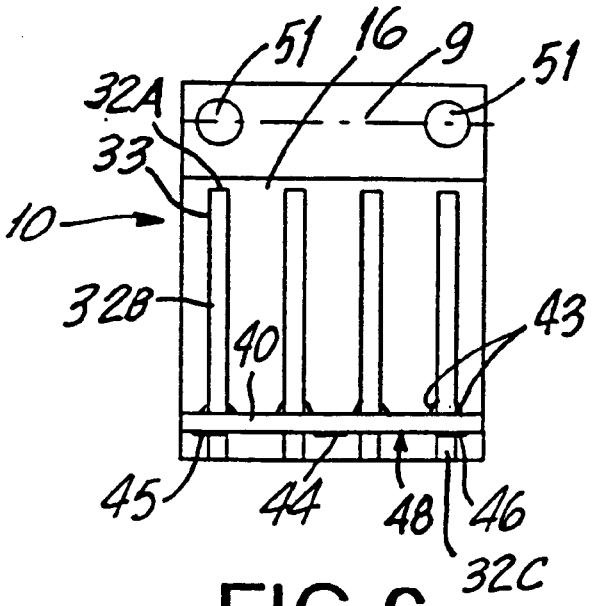
FIG. 6 is a rear view of the fuse holder shown in FIG. 1.
Figure 7:
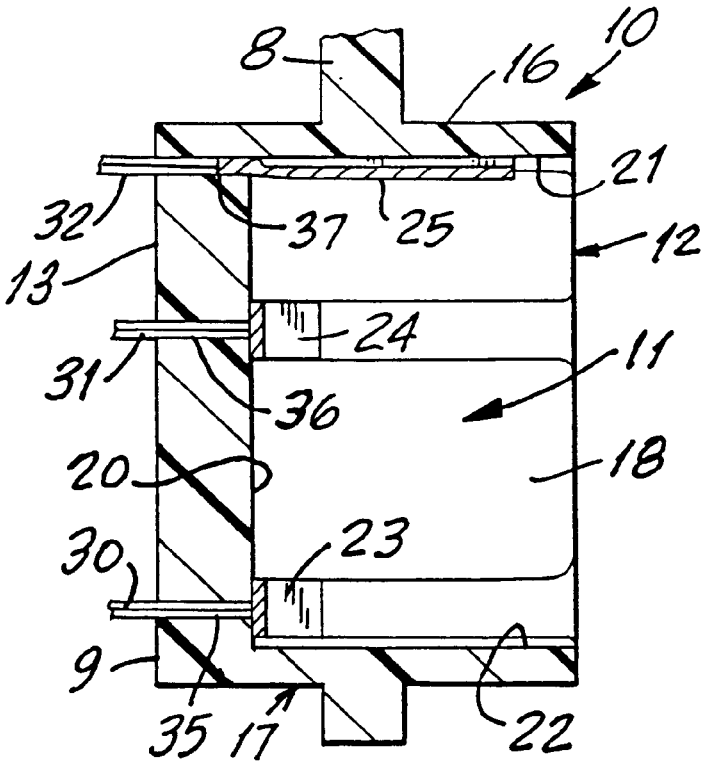
FIG. 7 is a sectional view taken along the line 7—7 of FIG. 3.

In the drawings, the holder 1 is shown mounted on a panel 50 by means of openings 51 in its upper flange as shown in FIG. 3 and FIG. 8. In the example shown, the lower flange may be supported by an L-shaped bracket 52 which may be secured to a panel 50. However, it will be understood that the fuse holder 1 may be mounted on panel 50 in any desired or conventional manner. Further, an embodiment having both upper and lower flanges with two openings on each flange provides another alternative style. For such embodiment, the L-shaped bracket 52 may require appropriate modification known to those skilled in the art.

The fuse box 10 of the fuse holder 1 may be inserted in an opening (not shown) in the panel 50 on top of an L-bracket 52 as shown in FIG. 8. The lower flange 9 may rest on the L-bracket 52. The lower ends 30C, 31C and 32C of the leads 30, 31 and 32 extend into or are in contact with the electrical contacts 61, 62 and 63 in the circuit board 60. The fuses 2 may be inserted within the fuse cavities 11. Since the cavities 11 are horizontally oriented with respect to each other and perpendicular to the copper clad board 40 and the circuit board 60, any number of such fuse cavities 11 may be positioned alongside each other depending on the size of the circuit board 60 with which the fuse holder is to be used. Hence, the fuse holder of the present invention provides a unique construction which permits horizontal spacing of the fuse cavities thus increasing the number of electrical circuits per surface of the circuit board. This affords greater flexibility as to the electrical equipment with which the fuse holder of the present invention may be used.

Although the invention has been described and illustrated with a certain degree of specificity, several obvious changes and modifications are suggested from the description herein. Such changes and modifications are nevertheless within the scope of the present invention.

What is claimed is:

1. A fuse holder comprising a copper clad board, a fuse box having opposed top and bottom walls, opposed front and rear faces, at least one fuse cavity in said fuse box, said fuse cavity extending from the front face towards the rear face and terminating short of said rear face, said fuse cavity being substantially parallel to the side walls and substantially perpendicular to the top and bottom walls, contacts within the cavity, said contacts being electrically connected to conductive leads extending through the rear face of the fuse box, said conductive leads formed in such a manner as to bend into a plane perpendicular to the bottom wall of said fuse box, said leads extending through the copper clad board and retained in a specified precise array providing predictable X–Y locations relative to a single reference lead.

2. A fuse holder as set forth in claim 1 wherein a plurality of said fuse cavities are provided in side-by-side relationship and in substantially parallel orientation to each other.

3. A fuse holder as set forth in claim 2 wherein an electrical contact is electrically connected to the extended and preformed electrical leads from the said contact.

4. A fuse holder as set forth in claim 3 wherein said fuse cavity has a plurality of internal contacts which are essentially connected to said extended and preformed electrical leads.

5. A fuse holder as set forth in claim 4 wherein the side walls are substantially parallel to each other and substantially perpendicular to the top and bottom walls and to the front and rear faces of the fuse box.

6. A fuse holder as set forth in claim 5 wherein each of the cavities has an internal rear wall, opposed internal top and bottom walls, and opposed internal side walls and wherein said internal walls are perpendicular to said internal rear wall and said internal top and bottom walls.

7. A fuse holder as set forth in claim 6 wherein an internal contact is disposed along the internal rear wall.

8. A fuse holder as set forth in claim 7 wherein and internal contact is disposed along the internal top wall of the cavity.

9. A fuse holder as set forth in claim 8 wherein a copper clad board is provided and wherein said leads extend through and are mechanically bonded to the copper clad board.

10. A fuse holder as set forth in claim 9 wherein said copper clad board is mounted on and provides relative support between the leads which extend therethrough.

11. A fuse holder as set forth in claim 10 wherein said leads extend through the copper clad board and are retained in a specified precise array providing predictable X-Y locations relative to a single reference lead.

12. A fuse holder as set forth in claim 11 wherein said leads extend through the copper clad board and are adapted to be placed into electrical contact with the contacts of a circuit board.

13. A fuse holder as set forth in claim 12 wherein standoff points are provided on the lower surface of said copper clad board.

14. A fuse holder as set forth in claim 13 wherein means are provided for mounting said fuse holder on a supporting structure.

* * * * *